US007510078B2

(12) United States Patent
Schmidt et al.

(10) Patent No.: US 7,510,078 B2
(45) Date of Patent: Mar. 31, 2009

(54) TOOL BOX

(75) Inventors: LaVern D. Schmidt, Montezuma, KS (US); Vincent G. Koehn, Montezuma, KS (US)

(73) Assignee: Montezuma Mgf., Inc., Montezuma, KS (US)

( * ) Notice: Subject to any disclaimer, the term of this patent is extended or adjusted under 35 U.S.C. 154(b) by 548 days.

(21) Appl. No.: 10/955,439

(22) Filed: Sep. 30, 2004

(65) Prior Publication Data

US 2006/0065563 A1 Mar. 30, 2006

(51) Int. Cl.
*B65D 85/00* (2006.01)

(52) U.S. Cl. ..... 206/372; 206/373

(58) Field of Classification Search ..... 206/372, 206/373, 349, 374, 375, 378; 248/300, 301; 211/70.6

See application file for complete search history.

(56) References Cited

U.S. PATENT DOCUMENTS

| | | | | |
|---|---|---|---|---|
| 1,763,756 | A | 6/1930 | Casapollo | |
| 3,003,618 | A | 10/1961 | Lebedzinski | |
| 4,266,835 | A | 5/1981 | Schmidt | |
| 4,303,158 | A | 12/1981 | Perkins | |
| 5,169,018 | A | 12/1992 | Fiore | |
| 5,193,706 | A | 3/1993 | Hanna et al. | |
| 5,242,050 | A | 9/1993 | Billings | |
| 5,456,358 | A | 10/1995 | Schmidt | |
| 5,626,244 | A * | 5/1997 | Mesna et al. | 211/60.1 |

OTHER PUBLICATIONS

Brochure of Star Sales Inc., entitled "CPL Products Division", published prior to Jun. 22, 1993.

Brochure of Montezuma Welding & Mfg, Inc., entitled "Compact Position Lock Tool Box", published prior to Jun. 22, 1993.

* cited by examiner

*Primary Examiner*—Mickey Yu
*Assistant Examiner*—Steven A. Reynolds
(74) *Attorney, Agent, or Firm*—Shook, Hardy & Bacon L.L.P.

(57) ABSTRACT

A tool box has a bottom portion, a pair of side portions, a back portion, a front portion, and a cover rotatably mounted adjacent the back portion. The cover has a horizontal section and a slanted section sloping downwardly from the horizontal section. A partition plate is positioned in the interior of the tool box and has a peg sheet mounted thereto with a row of pegs extending upwardly from the top of the partition plate. The upper ends of the pegs contact or are in close proximity to the horizontal section of the cover when the cover is in its closed position such that tools disposed on the pegs are secured in position. A pair of compartments are positioned in the interior, one near the bottom of the box and one intermediate the bottom and the top, both having a cover structure disposed thereon with peg sheets for maintaining tools in secured and unsecured positions.

17 Claims, 7 Drawing Sheets

TOOL BOX

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Numerous containers or boxes are known in the prior art for arranging tools of different shapes and sizes within a tool box. For instance, tool boxes sometimes have trays with longitudinal channels therein in which sockets for use with a ratchet drive are placed. Further, tool boxes with compartments in their interior for containing different sizes or structures of tools are known. These tool boxes, however, are disadvantageous because upon rough handling of the tool box or possible inversion of the tool box, the tools disposed in designated channels or areas become displaced and scattered throughout the tool box.

While adding individual lids to the compartments in a tool box can help prevent the intermingling of tools when the tool box is handled or inverted, such compartments, however, normally inhibit the tool box user from finding the appropriate tool when the main tool box cover is open. Thus, a tool box is needed which secures the tools placed inside such that handling of the tool box will not displace the tools from their respective positions. Furthermore, the tool box should allow visibility of the tools in their appropriate locations such that the tools can be easily found by the tool box user when the tool box cover is open.

Other types of tool boxes exist (e.g. U.S. Pat. No. 5,456,358) that have numerous storage pegs for the placement of tools and the cover oriented such that when the cover of the tool box is closed, the tools placed on the pegs are prevented from being dislodged from their respective pegs. The pegs on these such designs are formed from metal and individually welded to the plates from which they project.

The tool box depicted in the above reference is advantageous in that it secures tools placed on the pegs in their respective positions when the tool box cover is closed, and further, allows great visibility of tools contained in the box. However, uniformly spacing and aligning the individual pegs during the welding process is difficult as both the pegs and plates tend to deform from the heat of the welder. Thus, an improved method of manufacturing peg rows for tool boxes is needed which easily provides the uniform spacing and alignment.

SUMMARY OF THE INVENTION

Accordingly, it is an object of the present invention to maximize the storage capability of the tool box such that numerous tools can be secured at designated locations within the box.

It is a further object of the present invention to allow for maximum visibility of the tools in the box.

It is a further object of the present invention to allow numerous tools of various sizes to be held at designated locations within the box when the tool box cover is closed.

It is a further object of the present invention to prevent intermingling of the tools when they are in their secured positions.

It is a further object of the present invention to permit the secure storing of tools at locations in the tool box that are not adjacent the tool box cover, but that are still highly visible within the box.

It is a further object of the present invention to provide a method for forming the storage pegs of tool box such that uniformity and consistency exist in the spacing and size.

It is a further object of the present invention to provide a method for forming the storage pegs of tool box that reduces the amount of manual labor required to create a row of storage pegs.

According to the present invention, the foregoing and other objects are obtained by a tool box having a bottom portion, a pair of side portions, a back portion, and a front portion. The side portions each have an upper horizontal edge and a slanted edge extending forwardly and downwardly toward the front of the box. A cover is rotatably mounted at a location adjacent an upper edge of the back portion. The cover has a horizontal section which, when the cover is in a closed position, engages the upper horizontal edges of the side portions. The cover also has a slanted section sloping downwardly from the horizontal section which, when the cover is in a closed position, engages the slanted edges of the side portions.

A partition plate extends between the side portions of the tool box and is disposed at a position intermediate the back portion and the front portion. The partition plate extends from a location adjacent the upper horizontal edges of the side portions downwardly to a location above the bottom portion of the box such that a space is formed between the bottom portion and the lower edge of the partition plate. The space provides an expanse adjacent the bottom portion for the storage of additional items. A peg sheet having a plurality of upwardly extending pegs is disposed adjacent an upper edge of the partition plate and along one side of the plate. A second peg sheet is provided opposite the partition plate pegs sheet and is disposed on the back portion. Each of the pegs on the peg sheet has an upper end which is located adjacent the horizontal section of the cover when the cover is in its closed position such that tools with their apertures disposed on the pegs are secured in position.

An upper and lower storage compartments are formed from partition plates that extend between the sidewalls. The upper storage compartment has a lid rotatably attached to a top portion of the compartment. The lid cover is rotatable between an open position and a closed position. A plurality of peg sheets are disposed on the surface of the lid. The peg sheets contain a plurality of pegs for receiving the apertures of various tools. The lid is rotatable between a first position, wherein the tools on the pegs are prevented from being removed when the cover is closed, and a second position, wherein the user has access to the storage compartment. A latch cooperates with the lid to hold the lid in its second position and thereby provide the user access to the upper storage compartment. The latch is constructed such that a user may not unintentionally disengage it from the lid while the lid is in its second position.

The lower compartment is formed adjacent the bottom portion and has a lid rotatably attached to a rear portion of the compartment. The lid is rotatable between an open position and a closed position. A plurality of peg sheets are disposed on the surface of the lid. The peg sheets contain a plurality of pegs for receiving the apertures of various tools. The lid is rotatable between a first position, wherein the tools on the pegs are prevented from being removed when the cover is closed, and a second position wherein the user has access to the storage compartment. A latch cooperates with the lid to hold the lid in its second position to allow the user access to the lower storage compartment.

Additional objects, advantages, and novel features of the invention will be set forth in part in the description which follows and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 1:
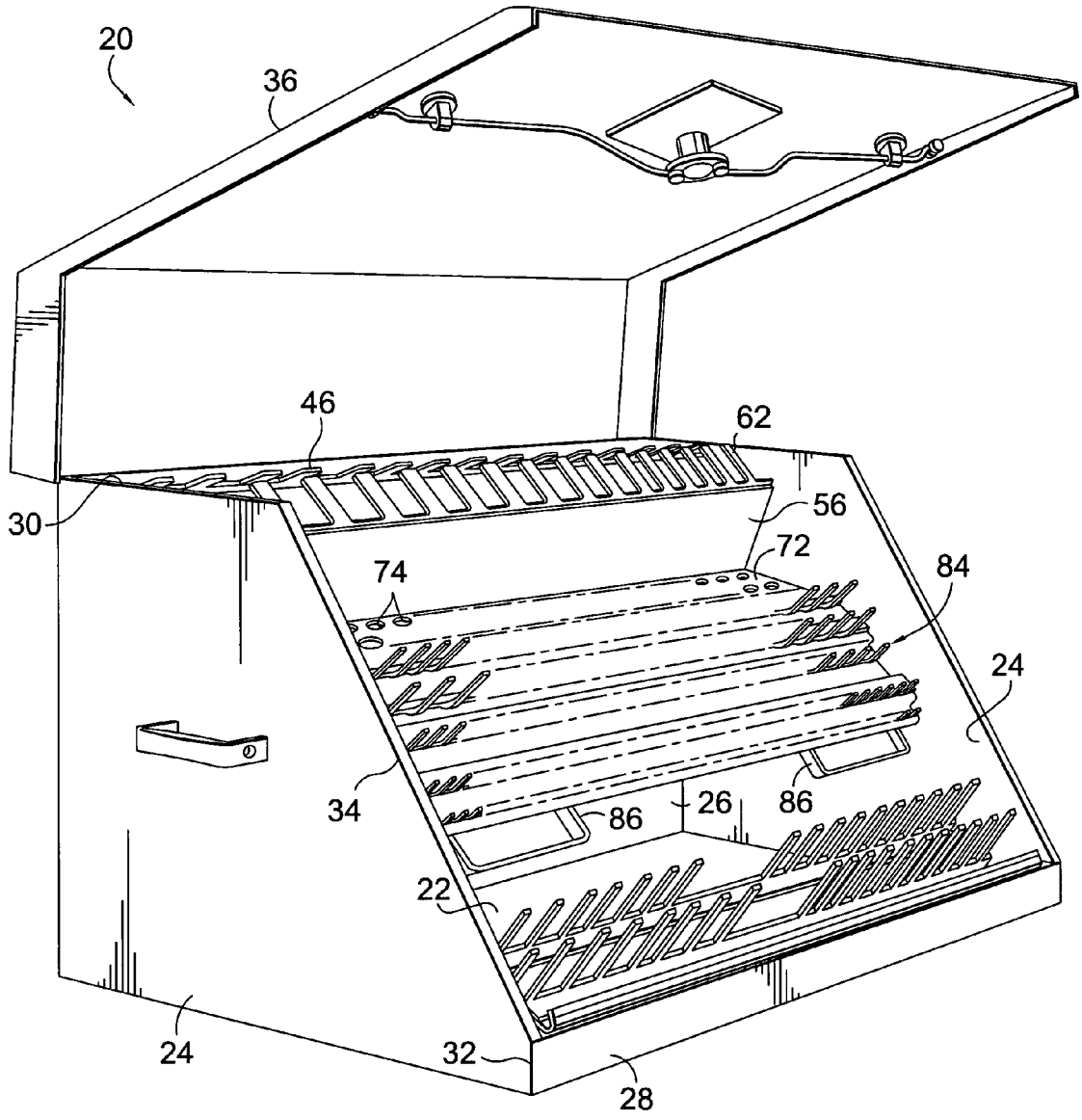
FIG. 1 is a perspective view of a first embodiment of a tool box of the present invention with the cover in an open position.
Figure 4:
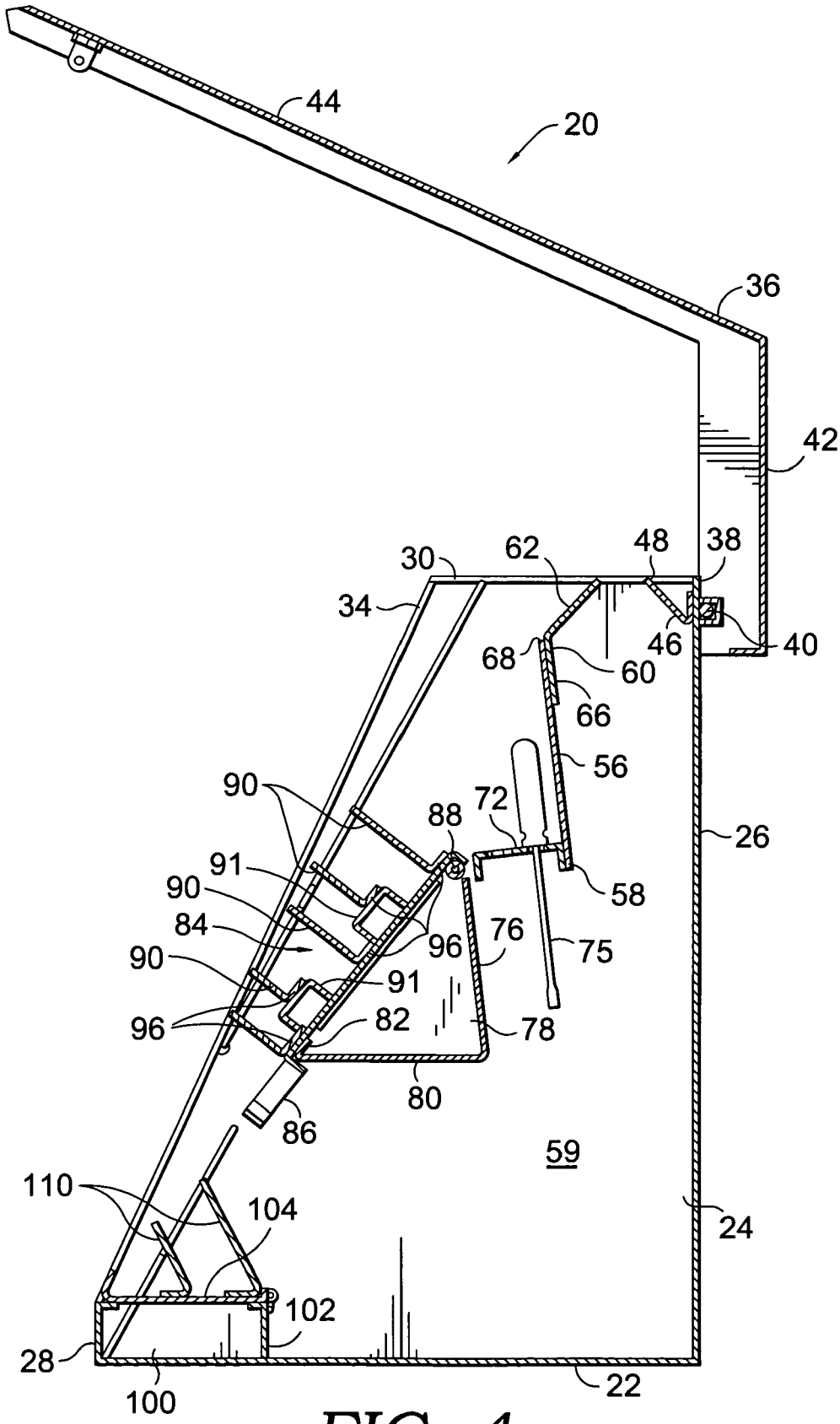
FIG. 4 is a right side, cross-sectional view of the tool box of FIG. 1.

With reference to FIGS. 1 and 4, tool box 20 constructed in accordance with the present invention is shown. Tool box 20 has a bottom portion 22, a pair of side portions 24 extending upwardly from bottom portion 22, a back portion 26 extending upwardly from bottom portion 22, and a front portion 28 extending upwardly from bottom portion 22. Side portions 24 each have an upper horizontal edge 30 and a front vertical edge 32. Upper edge 30 and front edge 32 are connected by a downwardly sloping slanted edge 34. Thus, bottom portion 22, side portions 24, back portion 26, and front portion 28 define an expanse in which tools or other items can be stored.

Figure 7:
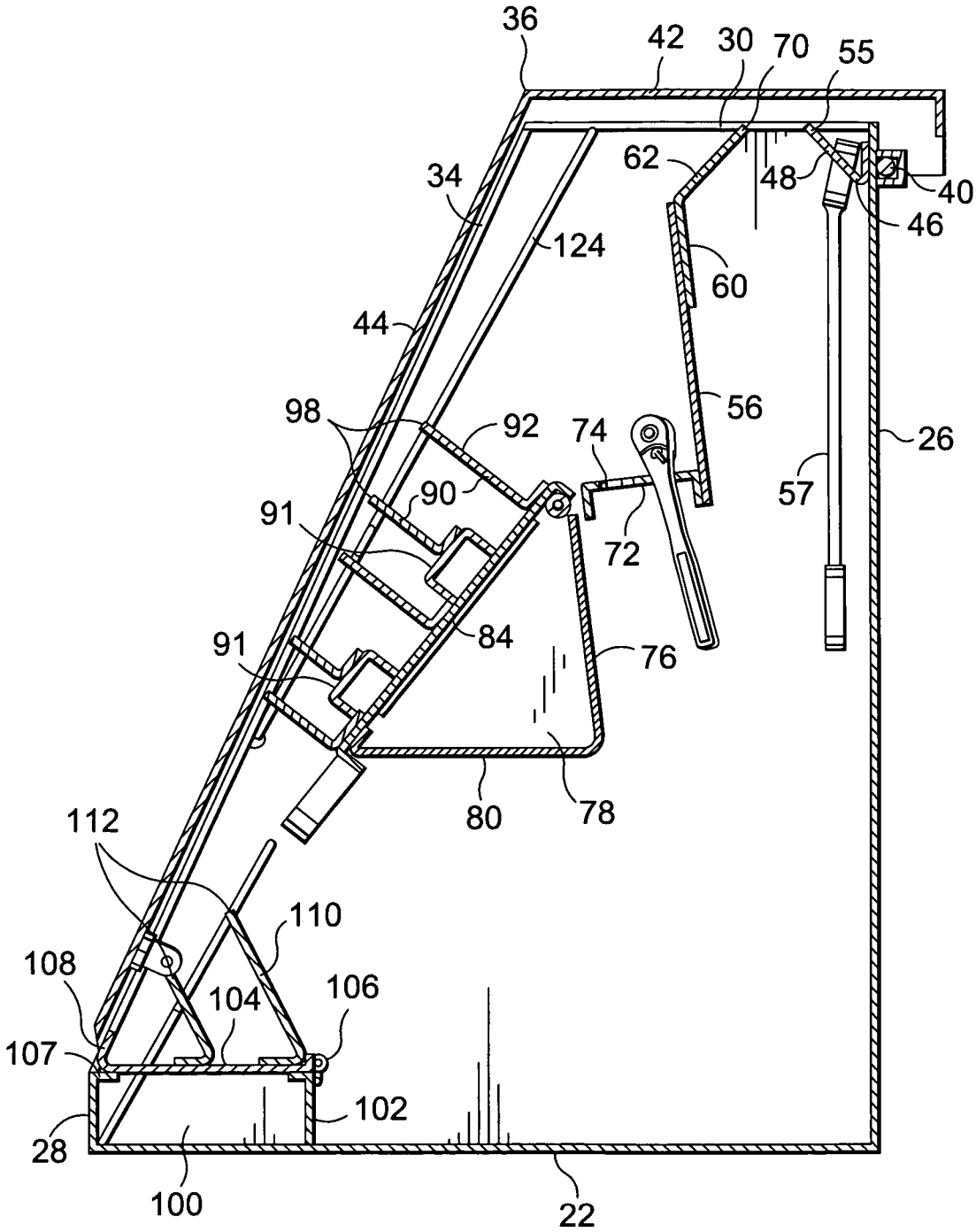
FIG. 7 illustrates the tool box of FIG. 4 with the cover in its closed position.

With additional reference to FIG. 7, a cover 36 is attached to back portion 26 at a location near upper edge 38 of back portion 26. Cover 36 is attached to back portion 26 by a hinge structure 40 such that cover 36 is rotatable between an open position, illustrated in FIG. 1, and a closed position, illustrated in FIG. 7. Cover 36 has a horizontal section 42 and a slanted section 44, which extends forwardly and slopes downwardly from horizontal section 42. When cover 36 is in its closed position, horizontal section 42 of cover 36 engages each upper horizontal edge 30 of side portions 24, and slanted section 44 engages each slanted edge 34 of side portions 24.

Figure 8:
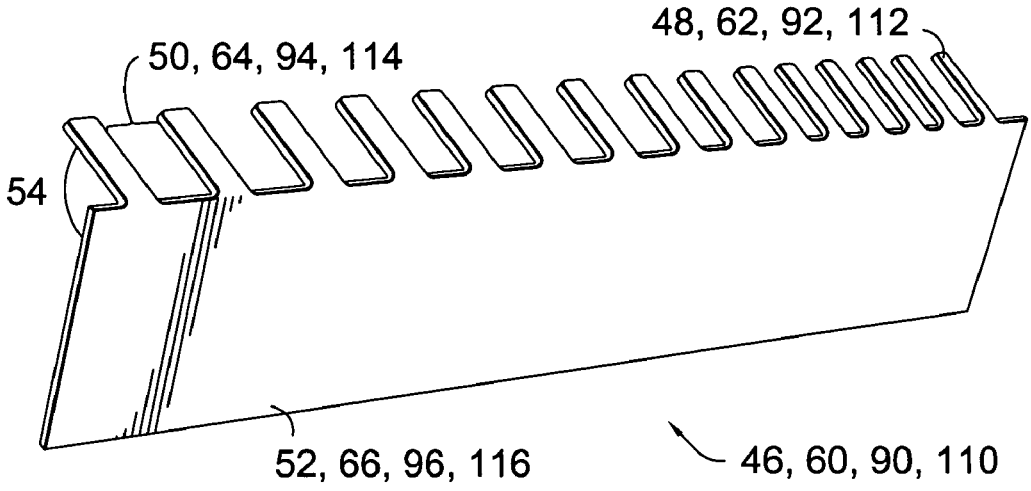
FIG. 8 is a perspective view of a peg sheet.

With reference to FIGS. 1, 4, 7 and 8, the structures in the upper portion of the tool box for holding tools in designated positions will be described. A first peg sheet 46 is attached to back portion 26 at a location adjacent upper edge 38. As best seen in FIG. 8, peg sheet 46 is formed from a flat sheet of metal. Peg sheet 46 has a plurality of pegs 48, a plurality of recesses 50, and a mounting plate 52. Pegs 48 are formed by cutting out a desired portion of the metal sheet. Pegs 48 are then bent to a desired angle as shown by reference numeral 54. Mounting plate 52 is used to attach peg sheet 46 to back portion 26. Peg sheet 46 is attached by welding or any other suitable attachment method. As will be appreciated, all the peg sheets are formed using the same method. Pegs of varying sizes and shapes may be formed by this method. Pegs may also be spaced at different dimensions and intervals depending on the amount of metal removed between the pegs. Different bend angles, as represented by referred numeral 54, are used depending on the locations of the peg sheets.

As best seen in FIG. 7, peg sheet 46 is bent so that pegs 48 are angled upwardly from back portion 26 such that upper ends 55 of pegs 48 are in engagement with or in close proximity to horizontal section 42 of cover 36 when cover 36 is in its closed position. Pegs 48 are used to hold elongated tools which have apertures that allow them to be disposed about the pegs 48. For instance, pegs 48 can be used to hold box-end wrenches or box-end/open-end combination wrenches. Because of the closure arrangement between back portion 26, peg 48, and horizontal section 42, an elongated wrench 57 with its aperture disposed about peg 48 is retained on peg 48 during movement of the tool box 20 and its movement within the tool box 20 is restricted.

A partition plate 56 extends between side portions 24 and is attached to side portions 24 at a position intermediate back portion 26 and front portion 28. Partition plate 56 preferably extends from a location adjacent upper horizontal edges 30 of side portions 24 to a location a substantial distance above bottom portion 22. As shown in FIG. 4, a space or expanse 59 is formed between a lower edge 58 of partition plate 56 and bottom portion 22. This space or expanse allows the storage of additional items or the positioning of additional structures within the lower portion of the tool box. As is apparent, partition plate 56 can be attached to side portions 24 by any suitable means, for example, by welding or a bolt arrangement.

As seen in FIGS. 4 and 7, a second peg sheet 60 is positioned on the side of partition plate 56 facing back portion 26. Peg sheet 60 has a plurality of pegs 62, a plurality of recesses 64, and a mounting plate 66, as seen in FIG. 8.

As seen in FIG. 4, peg sheet 60 is attached at its mounting plate 66 adjacent upper edge 68 of partition plate 56. Mounting plate 66 is attached by welding or any other suitable attachment method. As with pegs 48, pegs 62 are for holding tools having apertures which can be positioned about the pegs 62. As best seen in FIG. 7, upper ends 70 of pegs 62 are positioned at a location wherein, when cover 36 is closed, horizontal section 42 comes in contact with or is in close proximity to upper ends 70. Therefore, a tool (not shown) disposed about one of pegs 62 is prevented from being dislodged from peg 62 when cover 36 is in its closed position. Further, partition plate 56 prevents wrenches disposed on pegs 62 from intermingling with other tools disposed on the side of partition plate 56 opposite the side on which pegs 62 are disposed. Thus, partition plate 56 provides a barrier between tools disposed on pegs 48, 62 and tools on the other side of plate 56 such that they do not intermingle.

Different sets of wrenches can be designated to different rows of pegs 48 and 62. For instance, pegs 48 can be positioned such that a complete set of standard wrenches can be disposed thereon and pegs 62 can be positioned such that a complete set of metric wrenches can be disposed thereon.

Figure 2:
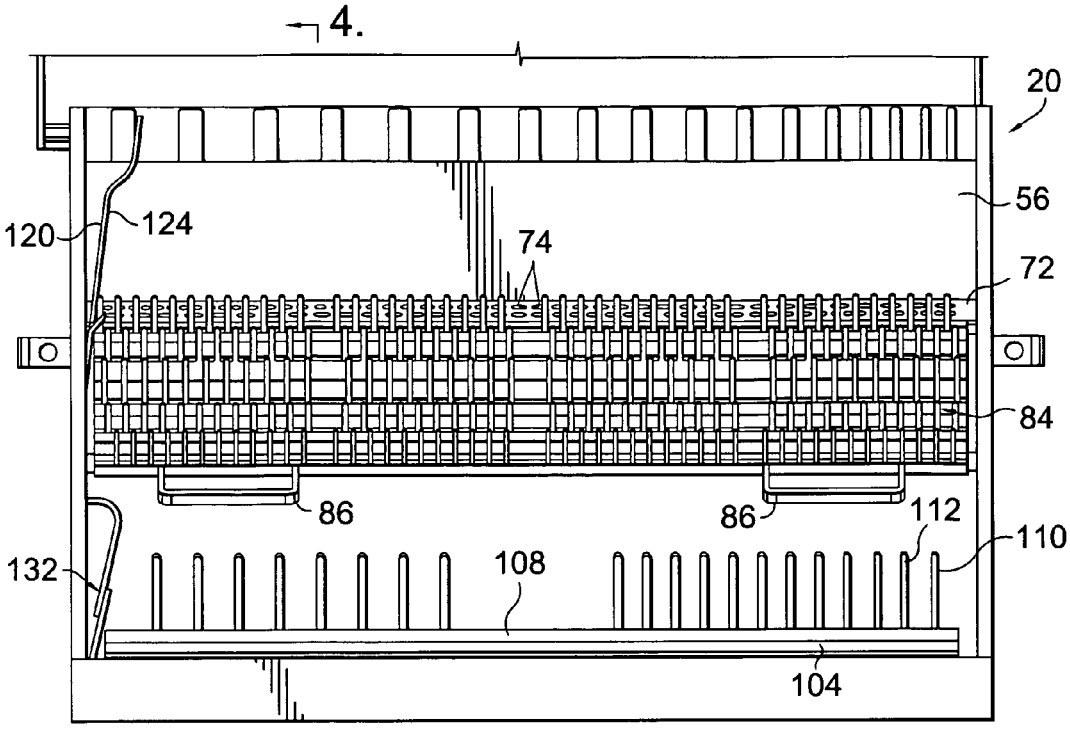
FIG. 2 is a fragmentary front elevational view of the tool box of FIG. 1 with the compartment lids in their first positions.

With reference to FIGS. 1, 2 and 4, a storage shelf 72 is positioned at a location forward of partition plate 56 and extends between side portions 24. Storage shelf 72 is preferably attached to side portion 24 by welding or any other suitable attachment method. Storage shelf 72 has a plurality of apertures 74 disposed therein. Apertures 74 receive the narrow ends of tools having enlarged handles or heads, for instance, a screwdriver 75 or ratchet drivers (not shown). Tools disposed in apertures 74 are prevented from being displaced from the apertures by cover 36 when it is in its closed position. Storage shelf 72 can hold a whole array of screwdrivers or ratchet drivers.

Referring now to FIG. 4, a dividing wall 76 extends downwardly adjacent a forward edge of storage shelf 72 between side portions 24. Dividing wall 76 prevents the intermingling of tools disposed in apertures 74 with tools in the forward portion of the tool box 20. Dividing wall 76 also provides a rear surface of an upper storage compartment or bin 78.

Storage bin 78 is defined at its rear by dividing wall 76. The bottom of storage bin 78 is formed by a partition 80 extending forwardly from dividing wall 76 and between side portions 24. Partition 80 has an angled portion 82 extending upwardly from the front of partition 80. In construction, dividing wall 76, partition 80 and angled portion 82 of storage bin 78 can be formed by bending a single sheet of metal along two fold lines.

Figure 3:
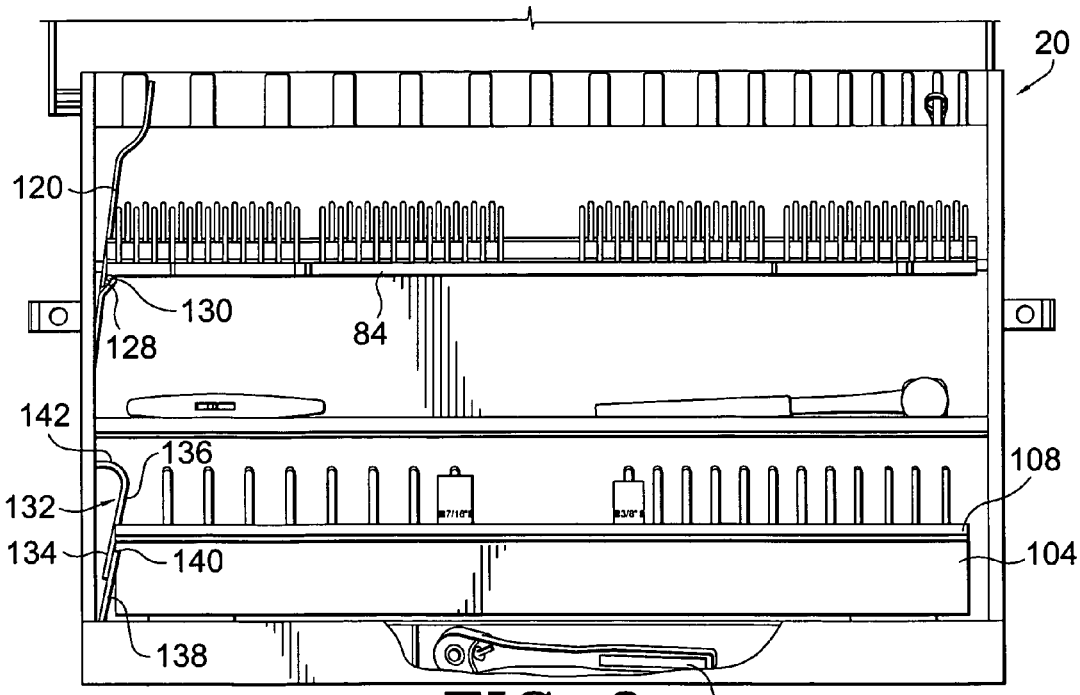
FIG. 3 is a fragmentary front elevational view of a tool box of FIG. 1 with the compartment lids in their second positions.
Figure 10:
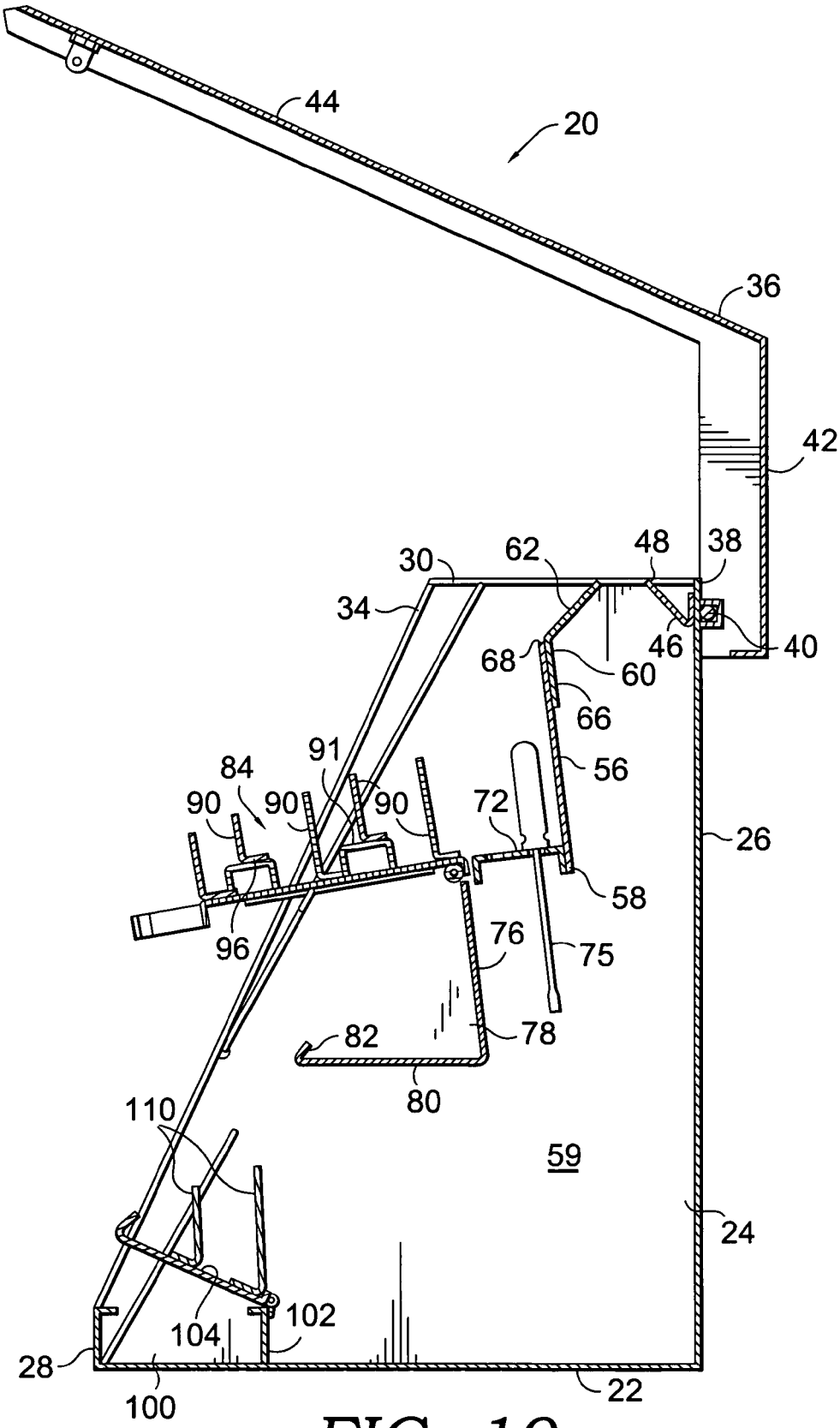
FIG. 10 is a right side, cross-sectional view of the tool box of FIG. 3.

As seen in FIGS. 1, 2 and 4, a socket shelf or lid 84 covers storage bin 78. Socket shelf 84 has a pair of handles 86 that serve to open socket shelf 84. Socket shelf 84 is attached proximate an upper portion of dividing wall 76 by a hinge 88 such that socket shelf 84 is rotatable between an open position, as illustrated in FIGS. 3 and 10, and a closed position, as illustrated in FIGS. 2 and 4. With specific reference to FIGS. 2 and 3, socket shelf 84 is shown in the closed position and open position, respectively. Socket shelf 84 preferably extends the length of storage bin 78 and rests on a front surface of angled portion 82, as best seen in FIG. 4, when in the closed position.

Attached to an outer surface of the socket shelf 84 is a socket storing arrangement. As best seen in FIGS. 4 and 7, this arrangement includes a plurality of peg sheets 90 and two raised channels 91. Peg sheets 90 are formed in the manner described above for peg sheets 46 and 60, are preferably metal, include a plurality of pegs 92, a plurality of recesses 94, and a mounting plate 96, as best seen in FIG. 8. Pegs 92 are preferably sized to receive the apertures of sockets. Each of the pegs 92 are preferably appropriately sized and spaced such that it will receive a different size of socket.

The two raised channels 91 are attached to the socket shelf 84 via welding and extend substantially along the length of the shelf 84. The channels 91 accommodate the storage of sockets of a shorter length. As best seen in FIG. 4, the peg sheets 90 are attached to both the socket shelf 84 and the raised channels 91 at their mounting plates 96 and extend substantially along the length of both. The peg sheets 90 are attached by welding, or any other suitable attachment method.

As shown in FIG. 7, when cover 36 is in its closed position, front ends 98 of pegs 92 engage or are in close proximity to slanted section 44 of cover 36. Thus, this engagement prevents the sockets from being dislodged from pegs 92 when the tool box 20 is handled or inverted.

With reference to FIGS. 1 and 7, the compartment located in the lower portion of the tool box and the structures associated with the compartments will be described. With particular reference to FIG. 7, a lower compartment 100 extends the longitudinal length of the tool box and is formed between front portion 28 and a partition wall 102. Partition wall 102 extends upwardly from bottom portion 22 and between side portions 24. Compartment 100 has a lid 104 that is attached by a hinge 106 to an upper edge of partition wall 102. Lid 104 extends the length of compartment 100 and rests on its front edge on supporting member 107. Lid 104 also has an angled forward portion 108 which serves as a grip for opening lid 104 and further engages cover 36 when cover 36 is in its closed position such that lid 104 is secured in a closed position, as shown in FIG. 7.

As shown in FIGS. 2 and 4, a socket storing arrangement is attached to the top of lid 104. This arrangement includes a pair of peg sheets 110 which extend substantially along the entire length of compartment cover 104. Peg sheets 110 are attached to lid by welding, or any other suitable attachment method. The peg sheets 110 as previously discussed and include a plurality of pegs 112, a plurality of recesses 114, and a mounting plate 116, as best seen in FIG. 8. Pegs 112 are sized to receive the apertures of sockets. Each of the pegs 112 is preferably appropriately sized and spaced such that it will receive a different size of socket. Sockets will be prevented from disengaging from pegs 112 when cover 36 is in a closed position in a manner similar to that described above with regard to pegs 92.

Different sizes of sockets can be disposed on the two different rows of pegs 112. For instance, the forward row of pegs 112 can be spaced such that a set of standard sockets can be positioned thereon while the rearward row of pegs 112 can be spaced such that a set of metric sockets can be disposed thereon.

Compartment 100 provides additional storage area for tools or other items of irregular shape that cannot be positioned elsewhere within the tool box. For instance, a socket wrench 118, as shown in FIG. 3, or other items can be positioned within the compartment 100.

Figure 9:
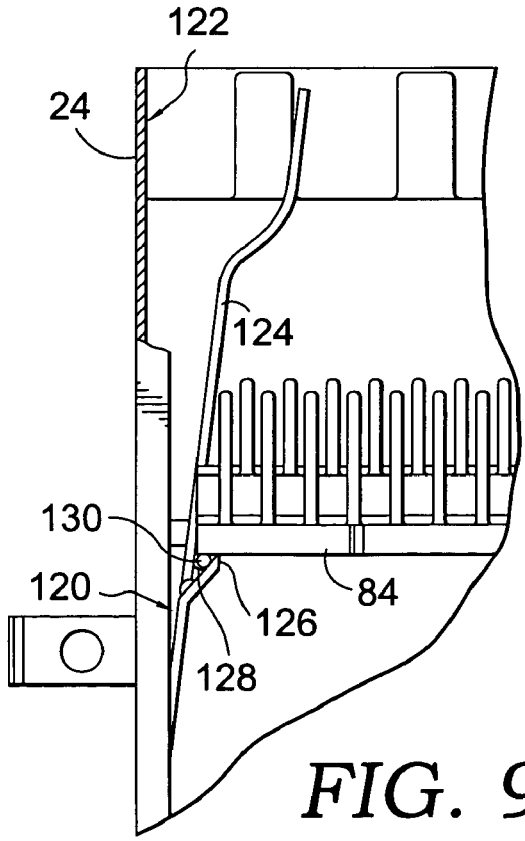
FIG. 9 is an enlarged, fragmentary view of a portion of FIG. 3 illustrating the latch of the upper compartment.

With reference to FIGS. 2, 3 and 9, a first lid support arrangement 120 will be described. As best seen in FIG. 9, arrangement 120 is positioned adjacent inner wall 122 of side portion 24 to selectively maintain the lid 84 in its open position. Arrangement 120 includes a flexible rod 124 that is preferably attached to the inner wall 122 adjacent its lower proximal end. Flexible rod 124 can be attached to inner wall 122 by welding or any other suitable manner. Flexible rod 124 is deformed inwardly toward the center of the toolbox 20 above its point of attachment. Thus, rod 124 is biased toward the interior of the tool box 20. Flexible rod 124 contains a catch 126 that extends at an angle to form a y-shaped channel 128. Flexible rod 124 is attached to the inner wall 124 at an angle such that as socket shelf 84 is moved into its open position the socket shelf 84 deflects the rod 124 toward the side portion 24. Once the socket shelf 84 clears the catch 126, the bias of the rod 124 deflects the rod 124 back into engagement with the socket shelf 84, with the catch 126 now below the socket shelf 84, as seen in FIG. 9. A rod 130 is then received in y-shaped channel 128. Rod 130 is attached to the underside of socket shelf 84 by welding or any other suitable method. The biasing of the flexible rod 124 inward works to prevent shelf 84 from rotating upwardly and to maintain the rod 130 in engagement with the catch 126.

Lid support latching arrangement 120 operates in the following manner. FIG. 2 shows the socket shelf 84 in its first or closed position, while FIG. 3 shows the socket shelf 84 in its second or open position. In order to move shelf 84 from the first to the second position, the user simply lifts upwardly on handles 86 and rotates shelf 84 toward the second position. When socket shelf 84 is in its second position, rod 130 rests in the y-shaped channel 128, as seen in FIGS. 3 and 9. Therefore, the flexible rod 124 supports socket shelf 88 with pegs 92 thereon in its second position to provide a user access to the storage bin 78.

In order to move the shelf 84 from its second position to its first position, the tool box user grasps a handle 86 with one hand and pivots the shelf 84 upwardly. Next, the user grasps the upper portion of flexible rod 124 with their other hand and deflects rod 124 outwardly toward side portion 24 of tool box 20. Shelf 84 is then allowed to pivot downwardly to its first position. It will be appreciated from the above description that the user may not move shelf 84 from the second position to the first position without first lifting shelf 84 to disengage rod 130 from y-shaped channel 126. Thus, y-shaped channel 126 provides a safety feature to prevent a user from unintentionally disengaging the lid support arrangement 120.

Figure 5:
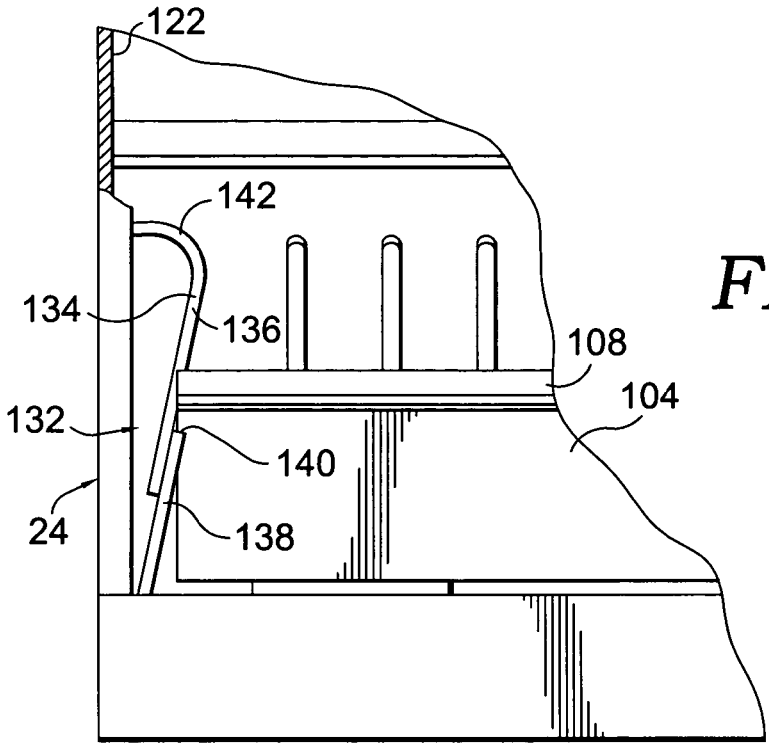
FIG. 5 is an enlarged, fragmentary view of a portion of FIG. 3 illustrating the latch of the lower compartment.
Figure 6:
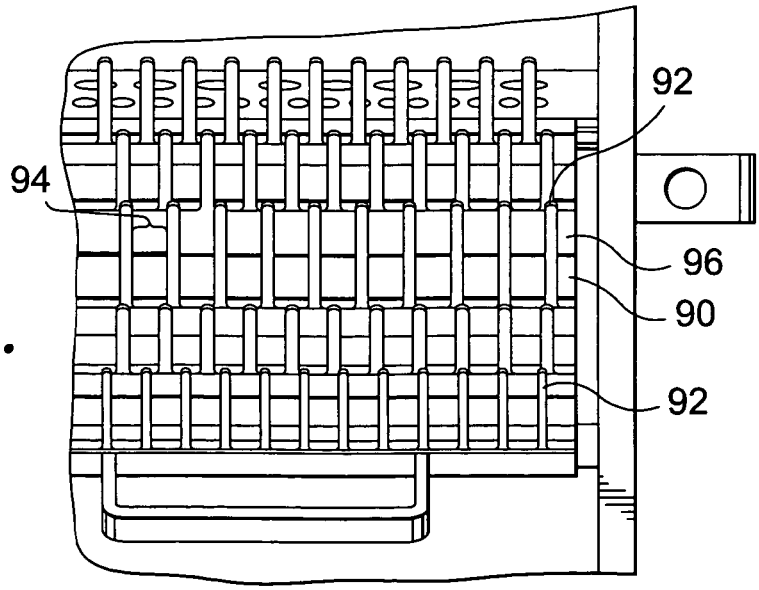
FIG. 6 is an enlarged, fragmentary view of a portion of FIG. 2 illustrating socket shelf.

With reference to FIGS. 2, 3, and 5, a second lid support arrangement 132, similar to the first lid support arrangement 120, will be described. As best seen in FIG. 5, arrangement 132 includes a flexible rod 134 that is positioned vertically and attached at its lower end to the inner wall 122. Flexible rod 134 can be attached to inner wall 122 by welding or any other suitable manner. Rod 134 is biased toward the interior of the toolbox 20. Flexible rod 134 has upper and lower portions 136, 138 that abut and are preferably attached by welding. The abutment serves to create a ledge 140 at an upper end of the lower portion 138. Ledge 140 serves to engage the lower surface of compartment cover 104. The top of upper portion 136 is deformed outwardly toward the inner wall 122 to form a bend 142. This bend 142 limits the amount of deformation of rod 134, when rod 134 is deflected outwardly toward the inner wall 122.

The second lid support arrangement 132 operates in the following manner. FIG. 2 shows the compartment cover 104 in its first or closed position, while FIG. 3 shows the compartment cover 104 in its second or open position. In order to move compartment cover 104 from its first position to second its position, the user simply lifts the angled forward portion 108 and rotates the front compartment cover 104 upwardly and rearwardly. When compartment cover 104 is in its second position, cover 104 rests on notch 140. Therefore, notch 140 can support compartment cover 104 in its second position. In order to move the compartment cover 104 from second position to first position, the tool box user deflects the upper portion of flexible rod 134 outwardly toward side portion 24 of tool box 20. Compartment cover 104 is then allowed to pivot downwardly to its first position.

Many variations can be made to the illustrated embodiment of the present invention without departing from the scope of the present invention. Such modifications are within the scope of the present invention. For example, in an alternate embodiment of the tool box 20, the metal of the tool box 20 can be aluminum to reduce the overall weight of the tool box. In such an arrangement, the peg sheets 46, 60, 90, 110 can be made of steel and simply bolted on to their corresponding support member. When cutting out the peg sheets 46, 60, 90, 110, holes (not shown) can be cut in the mounting plate 52, 66, 96, 116 at the same time, especially if the peg sheets are cut out by a CNC (computer numerically controlled) plasma cutter. The holes could even be square in shape to permit use of carriage bolts. Other modifications would be readily apparent to one of ordinary skill in the art, but would not depart from the scope of the present invention.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

The invention claimed is:

1. A tool box for securing in place tools with apertures therein, comprising:

a bottom portion;

a pair of side portions extending upwardly from said bottom portion;

a back portion extending upwardly from said bottom portion and between said side portions;

a front portion extending upwardly from said bottom portion and between said side portions;

a cover rotatably mounted at a location adjacent an upper edge of said back portion, said cover having a horizontal section and a slanted section sloping downwardly from said horizontal section, and wherein, when said cover is in a closed position, said horizontal section engages upper horizontal edges of said side portions and said slanted section engages slanted edges of said side portions;

a compartment formed between the side portions and between the cover and the bottom portion;

a compartment cover rotatably attached to an upper portion of said compartment and rotatable between an open position and a closed position, said compartment cover having a peg sheet disposed thereon for receiving tools within apertures therein, wherein said peg sheet is a unitary member formed of a single piece of material comprising:

(1) a mounting plate that is generally flat and is coupled with said compartment cover; and (2) a plurality of pegs that reside in a peg plane, wherein said peg plane is orientated in a substantial upward angle in relation to said mounting plate, wherein said plurality of pegs are separated by a plurality of recesses each having a horizontal edge that locates an angled bend between said plurality of pegs and said mounting plate;

wherein, when said cover is in its closed position, movement of the compartment cover from the closed position to the open position is prevented and the tools disposed on said plurality of pegs are prevented from being removed therefrom, and wherein, when said cover is in said open position, movement of the compartment cover from the closed position to the open position is permitted and tools disposed on said plurality of pegs are removable therefrom; and a lid support attached to said side portion for latching said rotatable compartment cover in its open position, wherein the lid support includes a flexible rod attached at a lower end thereof to an inner surface of the side portion and said rod includes a handle portion at an upper end, said rod having a protrusion laterally extending from a mid section thereof for engaging the compartment cover, wherein said protrusion is configured to hold said compartment cover in its open position, and wherein said compartment cover includes a ridge on its underside adjacent the side portion that is configured to engage with said rod.

2. The tool box of claim 1, wherein a rear portion of said compartment is formed by a partition wall extending downwardly from an intermediate position and disposed at a location intermediate said back portion and said front portion and intermediate said bottom portion and said cover.

3. The tool box of claim 2, wherein a bottom portion of said compartment is formed by a partition wall extending forwardly from a lower portion of said rear portion of said compartment.

4. The tool box of claim 1, wherein said protrusion extends in a y-shaped orientation and engages with said ridge to hold said compartment cover when in its open position such that the compartment cover may not be unintentionally disengaged.

5. The tool box of claim 4, wherein said rod is biased towards an inner portion of the compartment such that said compartment cover contacts said rod upon adjustment of said compartment cover from its closed position to its open position.

6. The tool box of claim 5, wherein the handle portion is configured to extend to a user-accessible space of the compartment, and wherein user-actuated deflection of the rod utilizing the handle portion disengages the compartment cover from the protrusion.

7. The tool box of claim 1, wherein said plurality of pegs comprising the peg sheet are flat sections of metal.

8. The tool box of claim 1, wherein the mounting plate of the peg sheet is attached to the compartment cover such that an upper portion of is in close proximity with said cover.

9. The tool box of claim 1, wherein a length dimension of the horizontal edge of at least one recess of the plurality of recesses varies from a length dimension of the horizontal edge of another recess of the plurality of recesses such that the plurality of pegs are spaced at differing intervals, wherein the length dimensions of the plurality of recesses are formed according to the tools disposed about each of the plurality of pegs.

10. The tool box of claim 1, wherein a width dimension of at least one peg of the plurality of pegs varies from a width dimension of another peg of the plurality of pegs such that the plurality of pegs are formed of varying sizes according to the tools disposed about each of the plurality of pegs.

11. The tool box of claim 1, wherein each of the plurality of pegs is sized to engage an aperture of a socket included in a set of sockets having varying-sized apertures.

12. The tool box of claim 1, wherein each of the plurality of pegs is further sized to support a socket engaged thereto in close proximity with the cover when in its closed position.

13. A tool box for securing in place tools with apertures therein, comprising:

a bottom portion;

a pair of side portions extending upwardly from said bottom portion, each of said side portions having an upper horizontal edge, a front vertical edge and a slanted edge connecting said upper edge and said front edge, said slanted edge sloping downwardly from said upper edge to said front edge;

a back portion extending upwardly from said bottom portion and between said side portions;

a front portion extending upwardly from said bottom portion and between said side portions;

a cover rotatably mounted at a location adjacent an upper edge of said back portion, said cover having a horizontal section and a slanted section sloping downwardly from said horizontal section, and wherein, when said cover is in a closed position, said horizontal section engages said upper horizontal edges of said side portions and said slanted section engages said slanted edges of said side portions;

a partition plate extending between said side portions and disposed at a position intermediate said back portion and said front portion, said partition plate extending from a location adjacent said upper horizontal edges of said side portions downwardly to a location above said bottom portion such that a space is formed between said bottom portion and a lower edge of said partition plate, said space providing an expanse adjacent said bottom portion for storage of additional items;

a peg sheet disposed adjacent an upper edge of said partition plate and along one side of said partition plate, said peg sheet is a unitary member formed of a single piece of material comprising:

(1) a mounting plate that is generally flat and is coupled with said one side of said partition plate; and (2) a plurality of pegs that reside in a peg plane, wherein said peg plane is orientated in a substantial upward angle in relation to said mounting plate, wherein said plurality of pegs are separated by a plurality of recesses each having a horizontal edge that locates an angled bend between said plurality of pegs and said mounting plate;

wherein the peg sheet including an upper end disposed adjacent said horizontal section of said cover when said cover is in a closed position, and wherein said tools are secured in position when their apertures are disposed on said peg sheet and the cover is in a closed position;

a compartment formed between the side portions and between the cover and the bottom portion;

a compartment cover rotatably attached to an upper portion of said compartment and rotatable between an open position and a closed position; and a lid support attached to one of said side portions for latching a rotatable compartment cover in its open position, wherein the lid support includes a flexible rod attached at a lower end thereof to an inner surface of the one of the side portions and said rod includes a handle portion at an upper end, said rod having a protrusion laterally extending from a mid section thereof for engaging the compartment cover, wherein said protrusion is configured to hold said compartment cover in its open position, and wherein said compartment cover includes a ridge on its underside adjacent the side portion that is configured to engage with said rod.

14. The tool box of claim 13, further comprising:

a second peg sheet disposed on the inside surface of said back portion adjacent said upper edge of said back portion, said second peg sheet having an upper end which is disposed adjacent said horizontal section of said cover when said cover is in the closed position, and whereby said tools with their apertures disposed on said second peg sheet are secured in position when said cover is in the closed position.

15. The tool box of claim 14, wherein the second peg sheet includes a plurality of pegs and a mounting plate, wherein one of said plurality of pegs of the second peg sheet is sized differently than each of said plurality of pegs extending from said peg sheet.

16. The tool box of claim 15, wherein the mounting plate of the second peg sheet is attached to the inside surface of the back portion adjacent said upper edge of said back portion.

17. The tool box of claim 13, wherein the mounting plate of the peg sheet is attached to the upper edge of the partition plate.

* * * * *